US007766198B2

(12) United States Patent
Mainetti

(10) Patent No.: US 7,766,198 B2
(45) Date of Patent: Aug. 3, 2010

(54) SIZER FOR A HANGER

(75) Inventor: Mario Mainetti, Valdagno (IT)

(73) Assignee: Mainetti S.p.A., Castelgomberto (IT)

( * ) Notice: Subject to any disclaimer, the term of this patent is extended or adjusted under 35 U.S.C. 154(b) by 21 days.

(21) Appl. No.: 11/168,815

(22) Filed: Jun. 28, 2005

(65) Prior Publication Data

US 2006/0006204 A1 Jan. 12, 2006

(30) Foreign Application Priority Data

Jul. 9, 2004 (IT) ..... VI2004A0168
Jan. 14, 2005 (IT) ..... VI2005A0007

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS 1,544,844 A 7/1925 Levkowits
4,123,864 A * 11/1978 Batts et al. ..... 40/322
4,160,333 A 7/1979 Indelicato
4,679,340 A * 7/1987 Johansson ..... 40/322
4,881,836 A * 11/1989 Blanchard ..... 40/322
6,070,772 A * 6/2000 Bond ..... 223/85
6,883,259 B2 * 4/2005 Johansson ..... 40/322
6,918,518 B2 * 7/2005 Blitz et al. ..... 223/85
D510,198 S * 10/2005 Willardson ..... D6/328
D528,807 S * 9/2006 Mainetti ..... D6/328
2006/0208012 A1 * 9/2006 Wu ..... 223/85

FOREIGN PATENT DOCUMENTS

JP 2004000404 1/2004

* cited by examiner

*Primary Examiner*—Shaun R Hurley
(74) *Attorney, Agent, or Firm*—Katten Muchin Rosenman LLP

(57) ABSTRACT

The crown sizer is mounted over the hook of a hanger and is positioned coaxially about a post that extends from the body of the hanger. The crown sizer is provided internally with one or more elastic protrusions which, in an operational stage, engage in the post of the hook, engage under reinforcing struts extending from the post to the body or engage in the hanger body in order to form a clip attachment of the crown sizer.

23 Claims, 7 Drawing Sheets

2
1
4

2
1
10.1
4
3
10

2
1
7
4
3

2
1
3
4
6

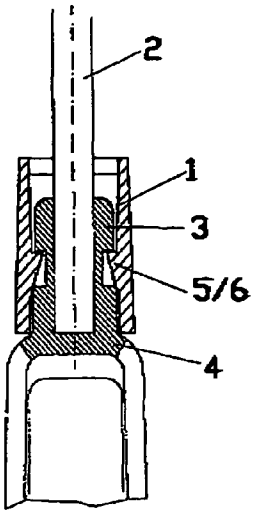
FIG.8
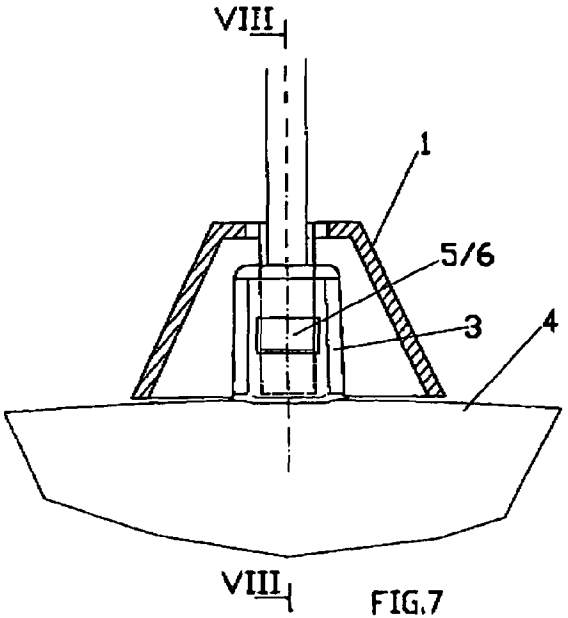
FIG.7
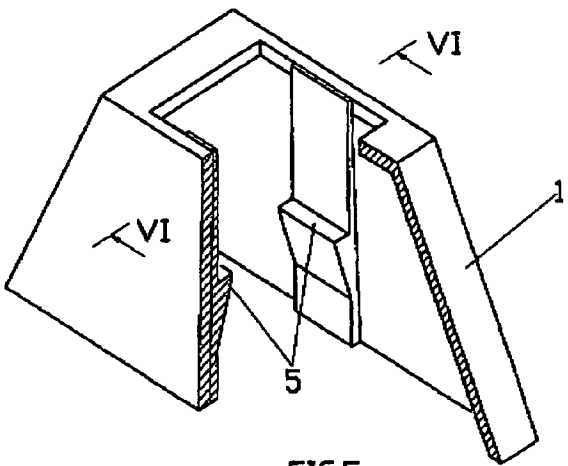
FIG.5
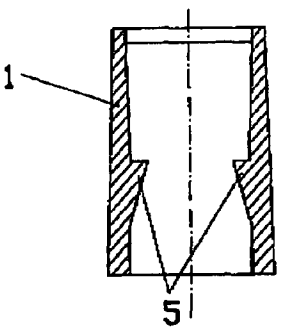
FIG.6
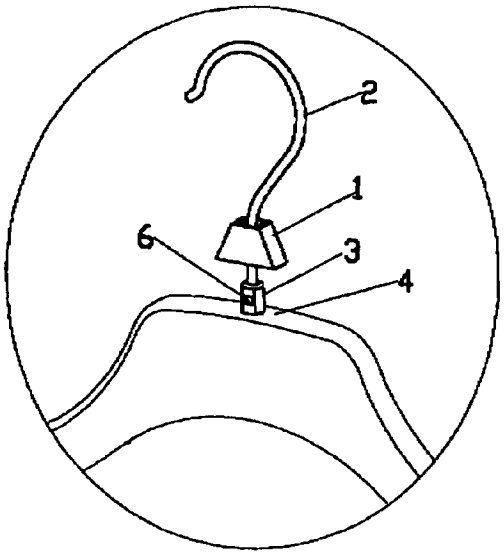
FIG.2.1

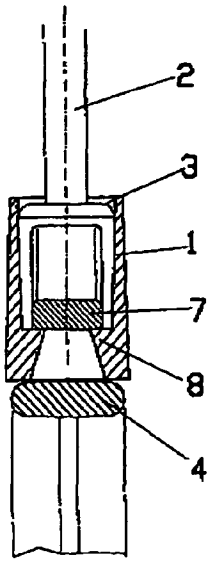
FIG.12
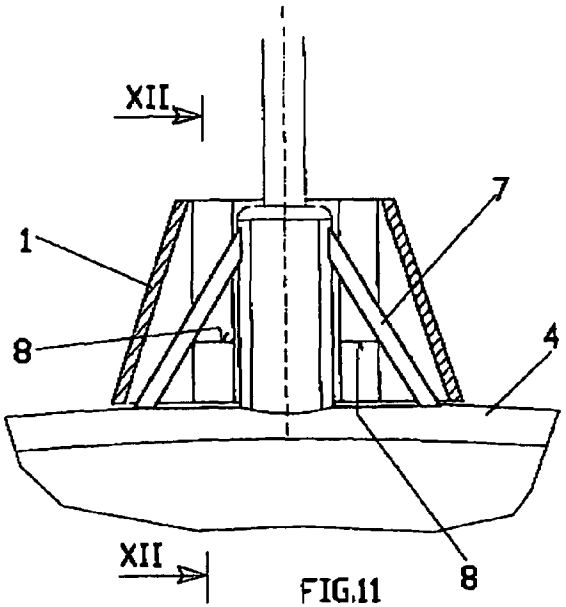
FIG.11
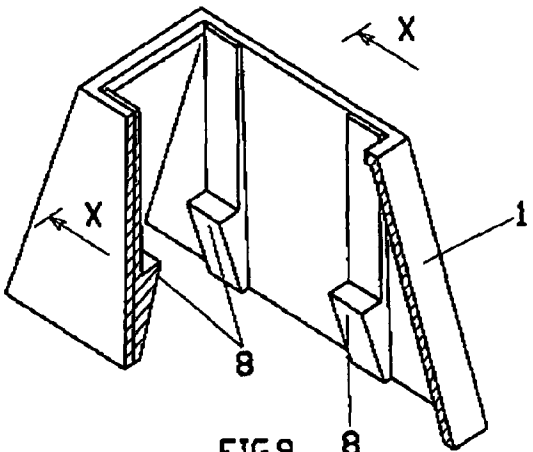
FIG.9
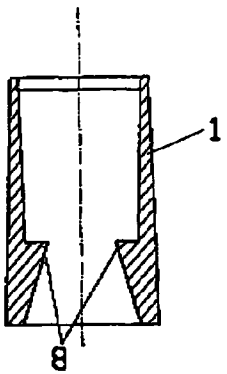
FIG.10
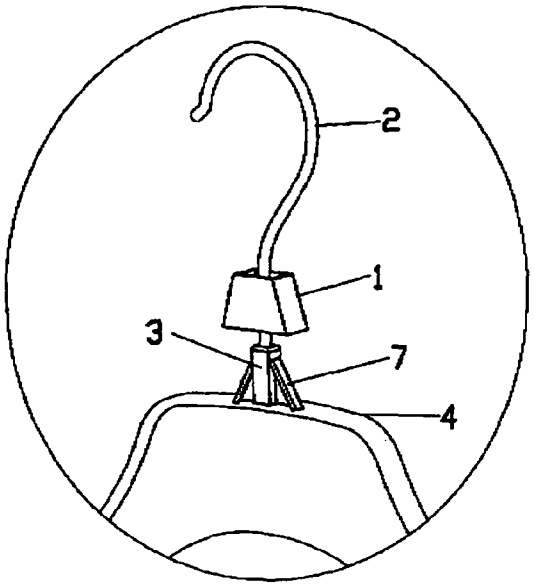
FIG.3.1

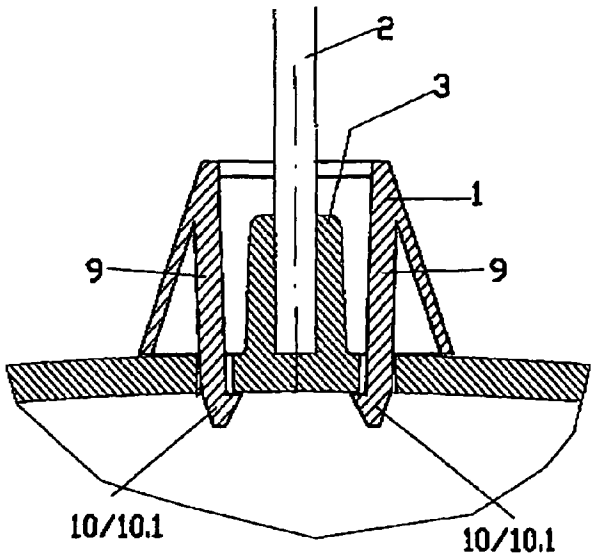
FIG.15
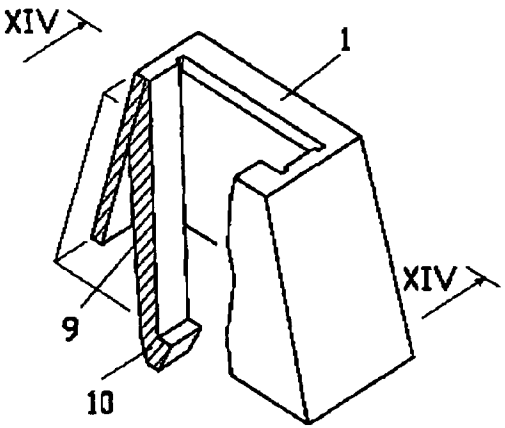
FIG.13
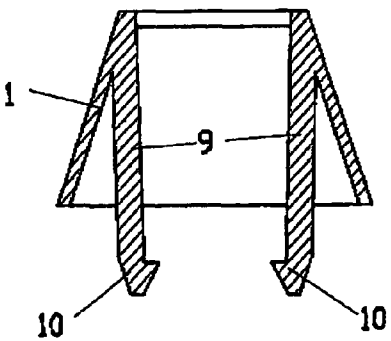
FIG.14
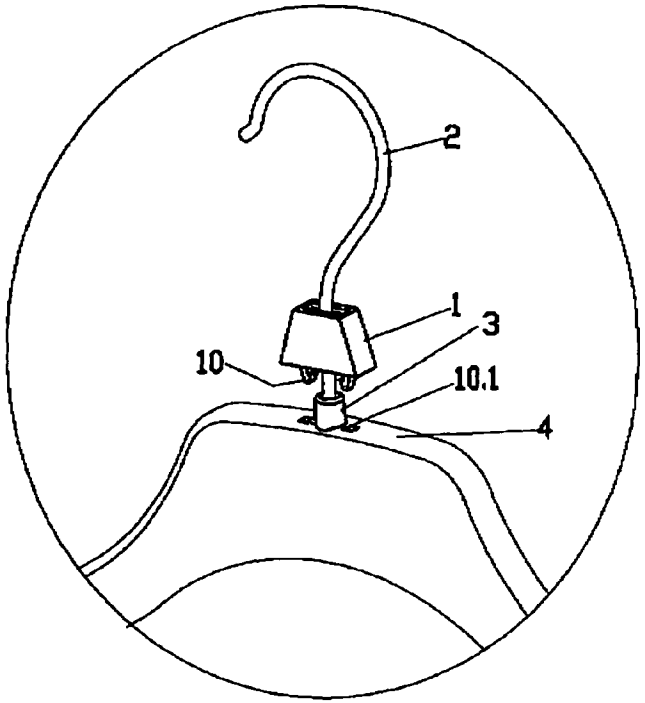
FIG.4.1

XXIII
11
1
XXIII 12
11
"T"
1

11
12
1

XXIV
16
15
1
XXIV 2
3
1
4

XXVI
XXV
16
3
1
XXVI
XXV 3
15
11

SIZER FOR A HANGER

CROSS-REFERENCE TO RELATED APPLICATIONS

This application claims priority to Italian Patent Application VI2004A000168 filed Jul. 9, 2004 and to Italian Patent Application VI2005A000007 filed Jan. 14, 2005.

BACKGROUND OF THE INVENTION

1 . Field of the Invention

This invention relates to a sizer for a hanger. More particularly, this invention relates to a crown sizer for mounting on the metal hook of a hanger. Still more particularly, this invention relates to a hanger having a crown sizer mounted thereon.

2. Description of the Related Art

The use of crown sizers is well known in many sectors, in particular, in retail sales domains, for application on products in order to identify them.

In the current state of the art, crown sizers of known type present the problem of being easy to detach from their positioning seat.

Such easy removal involves the risk of goods having missing crown sizers and the risk that certain goods can be exchanged with others by ill-intentioned persons during warehouse stock management or in the stores where the goods are on sale. This fact that is more possible, in particular, when the crown sizer is applied to clothes hangers in general for garment size identification marking.

Moreover, since clothes hangers are normally present in domestic environments, a danger exists in that, if the crown sizers are easily detachable, they are attractive to children as play objects, and because of their reduced size and bright color, they could be mistaken for a candy. Therefore, the danger exists that they could be swallowed.

In order to prevent any negative possibilities, crown sizers have been made that are assembled in an integral manner with a support on a hanger thereby making it very difficult to detach and remove them. However, such a construction compromises the entirety of the support to the point of making re-use of the hanger for different sized garments impossible.

SUMMARY OF THE INVENTION

Accordingly, it is an object of the invention to provide a crown sizer for a garment hanger that can be mounted in place in a manner that makes the sizer resistant to removal.

It is another object of the invention to provide a crown sizer for a hanger that can be removed for the hanger by the use of tools to allow re-use of the hanger.

It is another object of the invention to provide a crown sizer for a hanger that forms a reinforcing base for the hook of a hanger.

Briefly, the invention provides a sizer for a hanger having an arched body, an upstanding post on the body and a metal hook secured in the post. The sizer is comprised of a peripheral wall that defines an open base at a bottom end and an open top at an opposite upper end for passage over the metal hook and post of the hanger; and at least one protrusion on an interior of the wall for engaging with the hanger to secure the sizer to the hanger.

The sizer thus forms an encasing structure in a prismatic form, with both bases open, the lower base in order to receive the post at the base of the hook, and the upper base for passing over the hook. The sizer can be classified as a crown sizer as opposed to a side sizer or top sizer as such terms are known in the art.

The crown sizer is characterized in that the interior is configured with one or more elastic protrusions that, during the operational stage, realize a clip attachment of the sizer to the hanger. The attachment of the sizer to the hanger may be accomplished in different embodiments.

In one embodiment, the post on the hanger has a pair of slots on opposite sides and sizer has a pair of protrusions on opposite sides of the peripheral wall for engaging in the slots.

In another embodiment, the hanger has a pair of reinforcing struts, each of which is secured to and extends angularly between the body and the post and the sizer has one or more protrusions engaged between one of the struts and the post.

In still another embodiment, the hanger has a pair of seats in the body on opposite sides of the post and the sizer has one or more protrusions each engaged in a respective seat.

These and other objets and advantages of the invention will become more apparent from the following detailed description taken in conjunction with the accompanying drawings in which:

BRIEF DESCRIPTION OF THE DRAWING

FIG. 2.1 illustrates an enlarged view of a detail the sizer and hanger of FIG. 2;

FIG. 3.1 illustrates an enlarged view of a detail the sizer and hanger of FIG. 3;

FIG. 4.1 illustrates an enlarged view of a detail the sizer and hanger of FIG. 34 FIG. 5 illustrates a part perspective view of the sizer of FIGS. 2 and 2.1;

FIG. 6 illustrates a cross-sectional view of the sizer taken on line VI-VI of FIG. 5;

FIG. 7 illustrates a side view of the hanger of FIG. 2 and a part cross-sectional view of the sizer in place;

FIG. 8 illustrates a cross-sectional view taken on line VIII-VIII of FIG. 7;

FIG. 9 illustrates a part perspective view of the sizer of FIGS. 3 and 3.1;

FIG. 10 illustrates a cross-sectional view of the sizer taken on line X-X of FIG. 9;

FIG. 11 illustrates a side view of the hanger of FIG. 3 and a part cross-sectional view of the sizer in place;

FIG. 12 illustrates a cross-sectional view taken on line XII-XII of FIG. 11;

FIG. 13 illustrates a part perspective view of the sizer of FIGS. 4 and 4.1;

FIG. 14 illustrates a cross-sectional view of the sizer taken on line XIV-XIV of FIG. 13;

FIG. 15 illustrates a part cross-sectional view of the hanger and sizer of FIGS. 4 and 4.1 in place;

DETAILED DESCRIPTION OF THE INVENTION

Figures 1, 2, 3, 4:
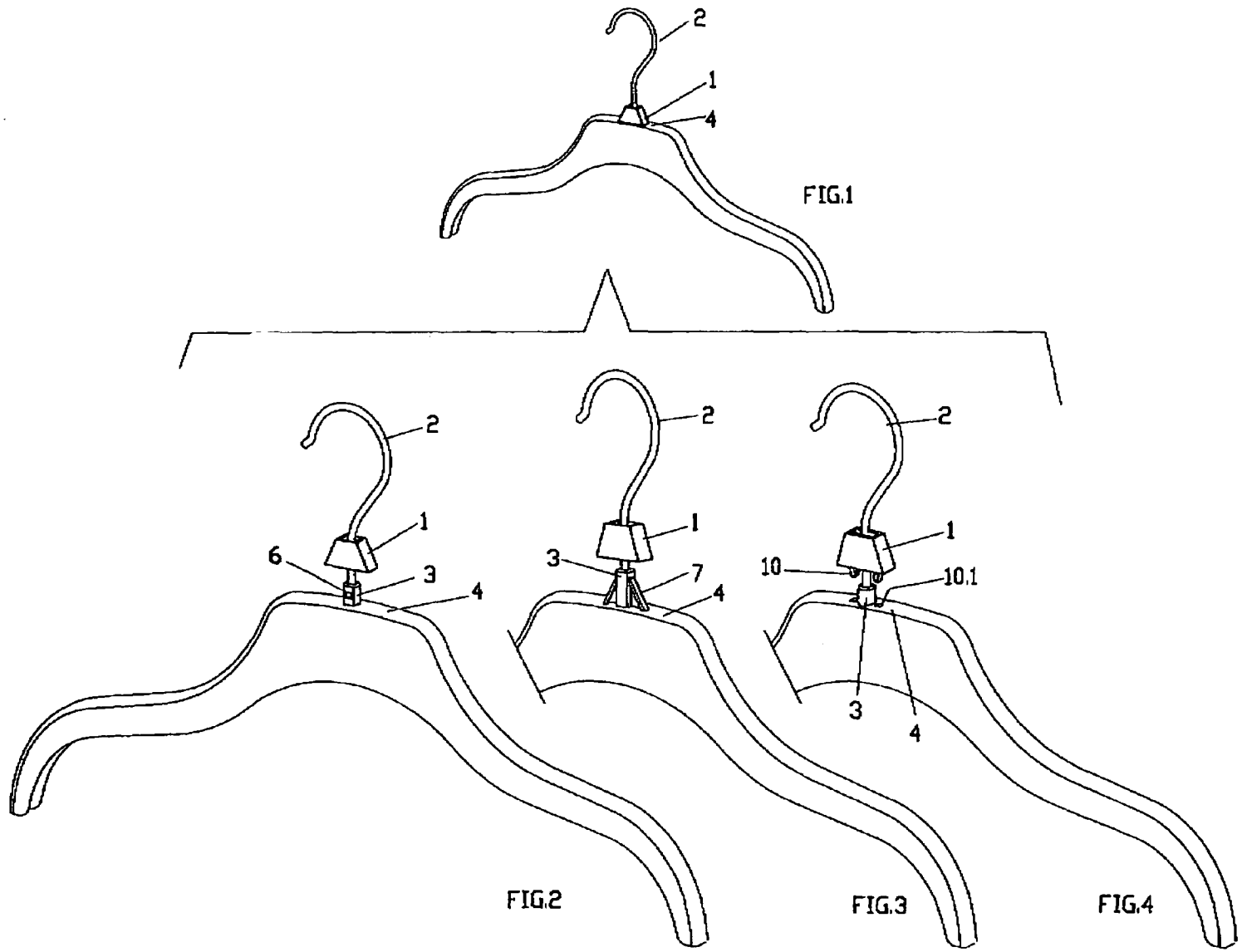
FIG. 1 represents a perspective view of a hanger in an operational stage.
FIG. 2 illustrates a perspective view of a hanger and crown sizer in accordance with the invention.
FIG. 3 illustrates a perspective view of a second embodiment of a hanger and crown sizer in accordance with the invention.
FIG. 4 illustrates a perspective view of a third embodiment of a hanger and crown sizer in accordance with the invention.

Referring to FIG. 1, a crown sizer 1 is positioned at the base of a metal hook 2 that is secured to an arched body 4 on a hanger after passing over the hook 2 where it acts as a size identification marker.

Referring to FIGS. 2 and 2.1, the hanger has a post 3 that extends upwardly from the body 4 to be encased by the crown sizer 1. The post 3 is provided with a pair of slots 6, one on each of two opposite sides of the post 3.

Referring to FIGS. 5 and 6, the crown sizer 1 has a peripheral wall that defines an open base at a bottom end and an open top at an opposite upper end for passage over the metal hook and post of the hanger. The crown sizer 1 also has a pair of oppositely disposed protrusions 5 on the interior of the peripheral wall for engaging within the slots 6 the hanger.

Referring to FIGS. 7 and 8, when in place, the protrusions 5 of the crown sizer 1 fit into the slots 6 of the post 3 of the hanger to secure the crown sizer in place. As shown, each protrusion 5 is in the form of a tooth with a sloped surface that allows the protrusion 5 to slide along the post 3 while expanding the lower part of the wall of the sizer 1 until the protrusion 5 snaps into a slot 6. At that time, a flat shoulder on the protrusion 5 fits into the slot 6 as shown in FIG. 8 to lock the sizer 1 in place relative to a reverse movement of the sizer 1 on the post 3.

As shown in FIG. 7, the width of a slot 6 is sized to accommodate the width of a protrusion 5.

Referring to FIGS. 9 and 10, wherein like reference characters indicate like parts as above, the crown sizer 1 may be made with a pair of spaced apart protrusions on each side of the interior of the peripheral wall. This embodiment is particularly adapted for clothes hangers where the post 3 is equipped on both sides with reinforcing struts or fins 7 as shown in FIGS. 3.1 and 11.

As shown in FIG. 11, the hanger has a pair of reinforcing struts 7, each of which is secured to and extends angularly between the body 4 and the post 3. The crown sizer is positioned so that each protrusion 8 fits between one of the struts 8 and the post 3 to secure the crown sizer 1 in place.

As above, each protrusion 8 is in the form of a tooth with a sloped surface that allows the protrusion 8 to slide along the post 3 while expanding the lower part of the wall of the sizer 1 until the protrusion 8 snaps under a strut 7. At that time, a flat shoulder on the protrusion 8 fits under the strut 7 as shown in FIG. 12 to lock the sizer 1 in place relative to a reverse movement of the sizer 1 on the post 3.

Referring to FIGS. 13 and 14, wherein like reference characters indicate like parts as above, in a third embodiment, the crown sizer 1 has a pair of oppositely disposed protrusions 9, each of which is disposed in depending relation to project from the peripheral wall to engage in the body 4 of the hanger. Each protrusion 9 is flexible and carries an integral tang 10 at the lower end that extends beyond the plane of the peripheral wall of the sizer 1.

Referring to FIG. 15, the hanger has a pair of seats 10.1 cut in the body 4 on opposite sides of the post 3 and the protrusions 9 of the sizer 1 are engaged in the respective seats 10.1. As above, each tang 10 is in the form of a tooth with a sloped surface that allows the tang 10 to slide through a seat 10.1 which is in the form of an opening while flexing outwardly until snapping under the seat. At that time, a flat shoulder on the tang 10 fits under the seat 10.1 as shown in FIG. 15 to lock the sizer 1 in place in the hanger relative to a reverse movement of the sizer 1.

Figure 17:
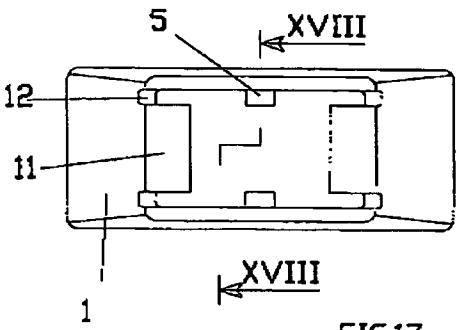
FIG. 17 illustrates a top view of the sizer of FIG. 16.
Figure 16:
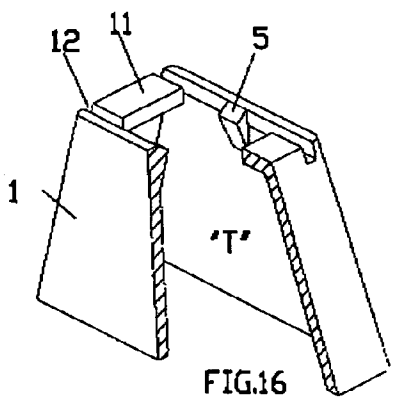
FIG. 16 illustrates a part perspective view of a modified sizer in accordance with the invention.
Figure 18:
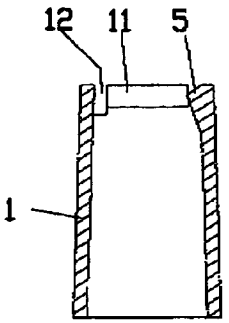
FIG. 18 illustrates a cross-sectional view of the sizer taken on line XVIII-XVIII of FIG. 17.

Referring to FIGS. 16 to 18, wherein like reference characters indicate like parts as above, in a fourth embodiment, the crown sizer 1 is provided with a pair of oppositely disposed protrusions 5 at the upper end of the peripheral wall to engage in the post 3 of a hanger. In addition, the sizer 1 has a pair of oppositely disposed fins 11 that project inwardly from the upper end of said wall to close the open top and a pair of recesses 12 on opposite sides of each fin 11 to render each fin 11 flexible relative to the wall. These recesses 12, which separate the fins 11 from the rest of the encasing structure, make the structure more flexible and thus easier to insert and position the crown sizer 1 on the post 3. As shown, each fin 11 is disposed in a plane perpendicular to a plane of a respective protrusion 5.

Figure 20:
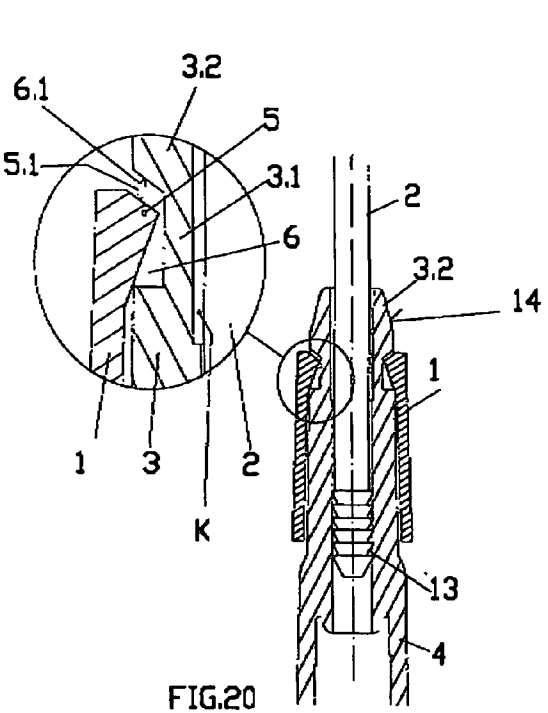
FIG. 20 illustrates a cross-sectional view taken on line XX-XX of FIG. 19.
Figure 19:
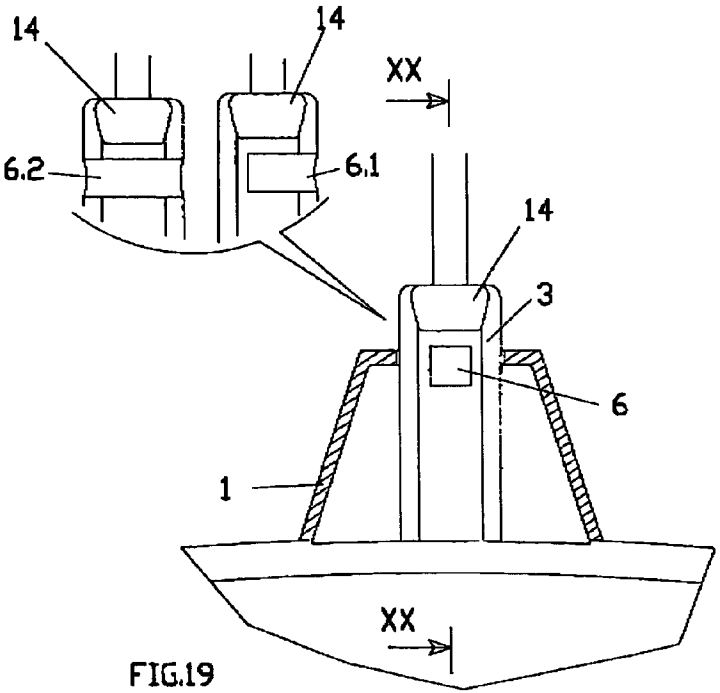
FIG. 19 illustrates a side view of a modified hanger with the sizer of FIG. 16 in place.

Referring to FIGS. 19 and 20, the post 3 of the hanger is provided with slots 6 on opposite sides to accommodate the protrusions 5.

As shown in FIG. 20, the protrusions 5 are positioned at the edge of the upper open wall. This constructive solution permits the attachment zone between the protrusions 5 and the corresponding slots 6 to be positioned near the upper part of the post 3. Advantageously, this zone is sufficiently distanced from the portion of the post 3 in which the terminal part or "nail" 13 of the hook 2 is embedded, and therefore the zone is not subject to deformation during the insertion stage of the hook 2 in the post 3 itself.

Moreover, as can be seen in the detail view of FIG. 20, the hook 2 is secured in the post 3 via the nail 13 and has an outside diameter smaller than an inside diameter of a counterbore of the post 3 to define an annular gap or channel K between the hook 2 and the counterbore. The post 3 thus has a reduced neck 3.1 in which the slots 6 are disposed in the plane of counterbore so that when the nail 13 of the hook 2 is passed therethrough, the nail 13 does not deform the reduced portion 3.1 and the respective slots 6.

As shown in the detail view of FIG. 20, each protrusion 5 presents a spire-shaped section where the vertex is defined by two sloping surfaces in relation to the horizontal plane, in order to facilitate both the attachment and detachment stages in the slot 6, when the size-marker wedge clamp needs to be removed from the hanger, for example, for recycling.

In particular, the surface 5.1 of each protrusion 5 and the surface 6.1 of each post.6, which during operational stage, face each other mutually, are set in a sloping position so that by varying the angle, it is possible to increase or reduce the force required to remove the crown sizer 1. This is particularly important to guarantee protection against tampering on the part of small children.

Furthermore, as shown in the detailed view in FIG. 19, in order to facilitate the attachment between a protrusion 5 and a slot 6, each slot 6 can be configured to be open on one side 6.1, or configured to be open on both sides 6.2, in order to receive protrusions 5 of varying widths of any type.

In order to simplify the insertion of the crown sizer 1 on the post 3, the upper portion 3.2 of the post 3 is configured in a slightly wedge-shaped form, by the creation of sloping surfaces 14, on which the protrusions 5 slide during mounting of the crown sizer 1 in place.

Figures 21, 22, 23, 24, 25, 26:
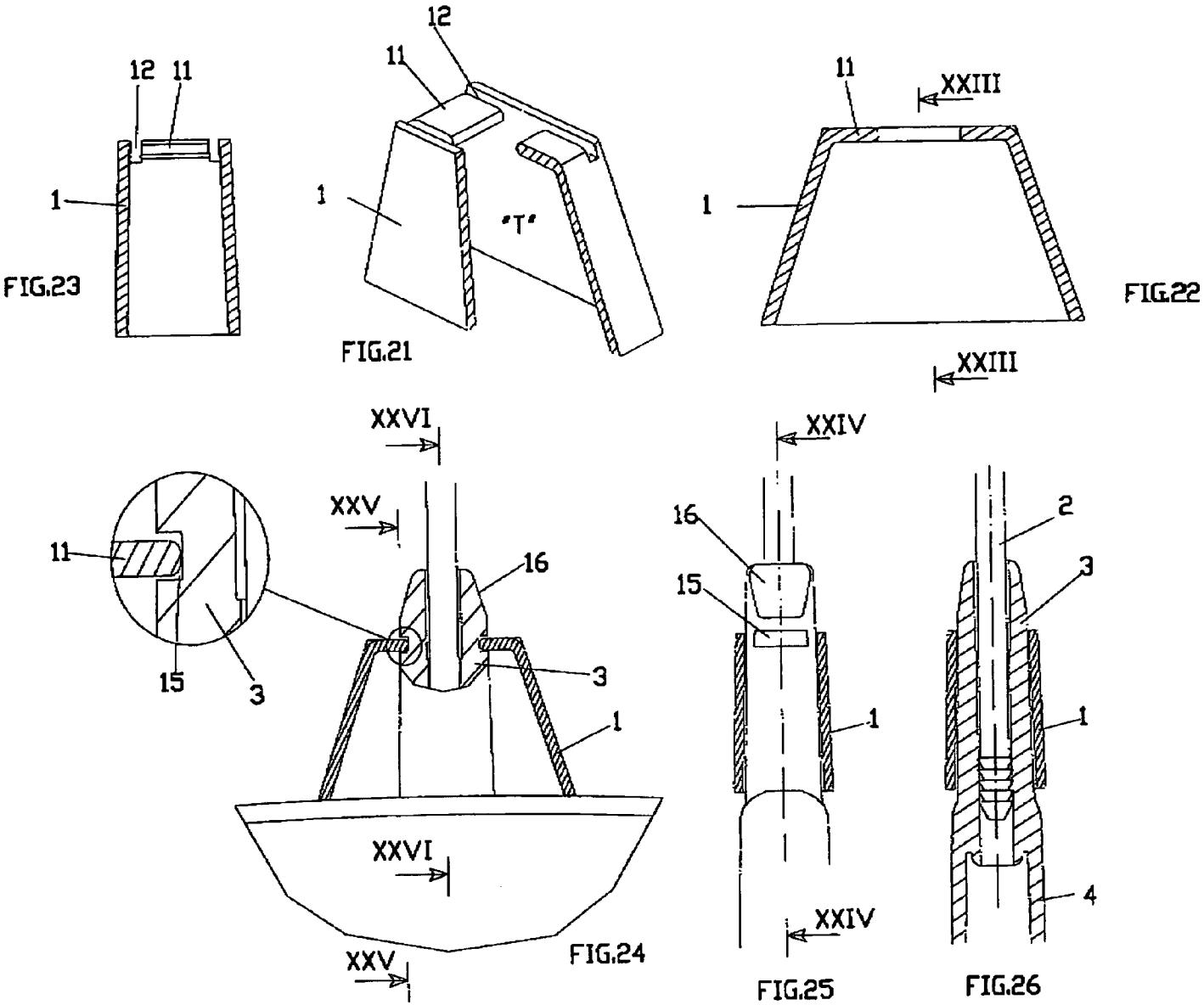
FIG. 21 illustrates a part perspective view of a further modified sizer in accordance with the invention.
FIG. 22 illustrates a cross-sectional view of the sizer of FIG. 21.
FIG. 23 illustrates a cross-sectional view of the sizer taken on line XXIII-XXIII of FIG. 22.
FIG. 24 illustrates a partial cross-sectional side view of a modified hanger with the sizer of FIG. 21 in place.
FIG. 25 illustrates a view taken on line XXV-XXV of FIG. 24.
FIG. 26 illustrates a view taken on line XXVI-XXVI of FIG. 24.

Referring to FIGS. 21 to 23, wherein like reference characters indicate like parts as above, in a fifth embodiment, the crown sizer 1 is provided only with a pair of oppositely disposed fins 11 and a pair of recesses 12 as above at the upper end.

Referring to FIG. 24, the crown sizer 1 cooperates with a post 3 having slots 15 on opposite sides that receive the fins 11 in interlocking relation to secure the sizer 1 to the post 3. Specifically, as can be seen in FIG. 24, the slots 15 are positioned in front of the fins 11 and are arranged rotated by 90° in relation to the slots 6 described previously (See FIG. 19)

In this embodiment, in order to simplify the insertion of the crown sizer 1 on the post 3, the upper portion 3.2 of post 3 is provided with sloping surfaces 16 on which the ends of the fins 11 are engaged to slide before they are fitted in the corresponding slots 15.

Figure 27:
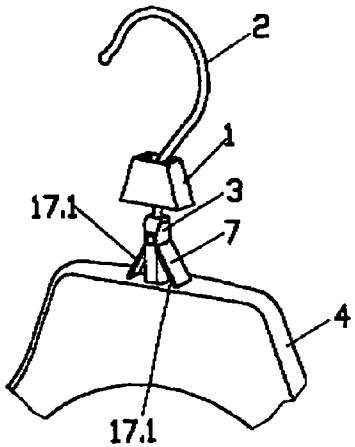
FIG. 27 illustrates a part-perspective view of a sizer in accordance with the invention in place in a non-rotatable manner on a hanger.
Figure 28:
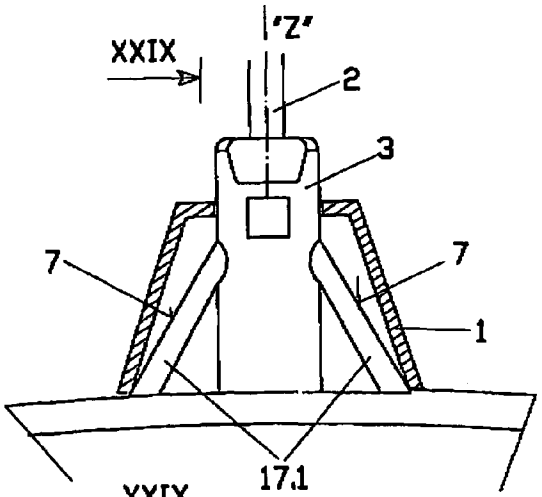
FIG. 28 illustrates a side view of the modified hanger and sizer of FIG. 27.
Figure 29:
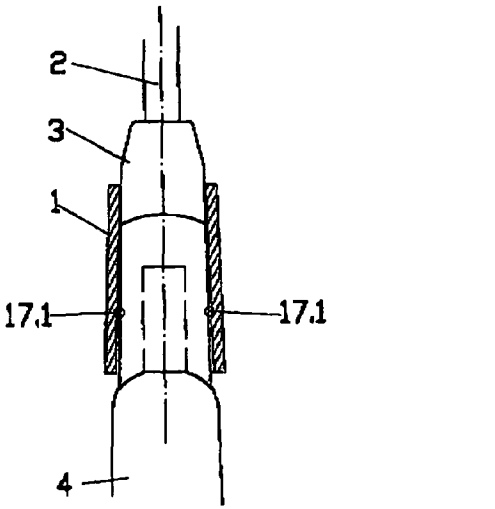
FIG. 29 illustrates a view taken on line XXIX-XXIX of FIG. 28.

Referring to FIGS. 27 to 29, wherein like reference characters indicate like parts as above, in order to facilitate the positioning and centering of the crown sizer 1 on a hanger, at least one side wall 17.1 is formed between the body 4 and the post 3 that is sized to move into contact with the internal part "T" of the crown sizer 1. Therefore, the side wall 17.1 prevents a mutual rotation of the post/crown sizer around the "Z" axis of hook 2.

Where the hanger is made as shown in FIG. 3.1 with a pair of struts 7, each strut 7 may be made with a width equal to the width of the post 3 to prevent rotation of the sizer 1 in a manner similar to the side walls 17.1.

Figure 30:
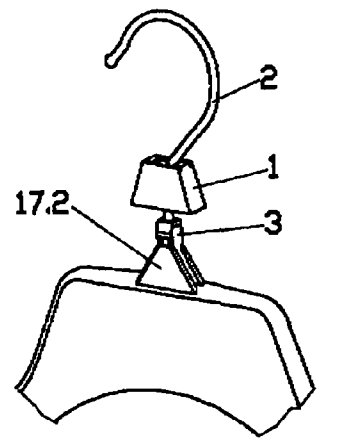
FIG. 30 illustrates a part-perspective view of a sizer in accordance with the invention in place in a non-rotatable manner on a modified hanger.
Figure 31:
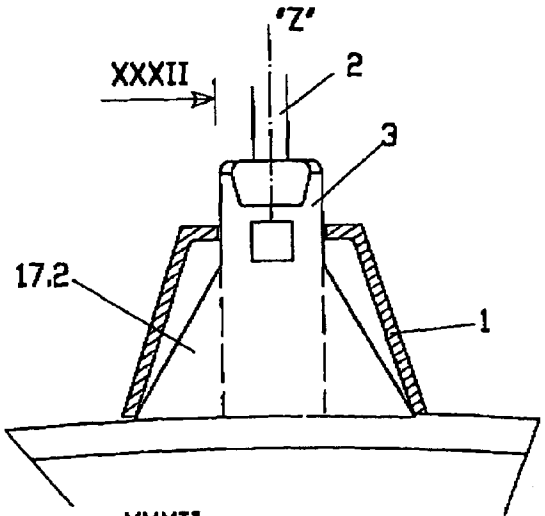
FIG. 31 illustrates a side view of the modified hanger and sizer of FIG. 30.
Figure 32:
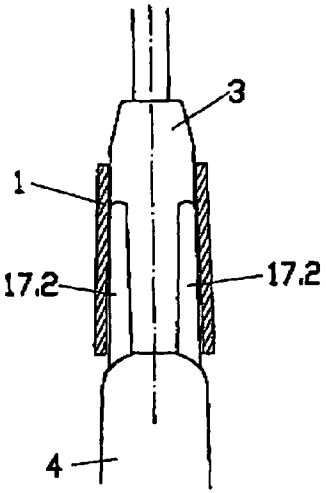
FIG. 32 illustrates a view taken on line XXXII-XXXII of FIG. 31.

Alternatively, as can be seen in FIGS. 30 to 32, the hanger may be made with side walls 17.2 of a triangular shape that sandwich the post 3, that is basically a substantially cylindrical element, therebetween so as to form an "inverted "U" shaped section. These side walls 17.2 serve to prevent rotation of the sizer 1 about the axis of the post 3.

As shown in the several embodiments, when the crown sizer 1 is in place, the bottom end either seats on the body 4 of the hanger (see FIG. 15) or is slightly spaced from the body 4 (see FIGS. 8 and 12) so that access to the underside of the crown sizer is substantially precluded.

Naturally other different embodiments can be realized for crown sizers based on the prismatic configuration of the crown sizer and the type of support, however, these remain within the context of the claims defined below.

The invention thus provides a crown sizer for a garment hanger that can be mounted in place in a manner that makes the sizer resistant to removal and that forms a reinforcing base for the hook of a hanger.

What is claimed is:

1. A sizer for a hanger, the hanger having a body, an upstanding post on the body and a metal hook secured in the post, the sizer comprising:

a bottom end proximal to the hanger body and an upper end distal from the hanger body, the bottom end defining a first peripheral rectangular shape in a first plane and the upper end defining a second peripheral rectangular shape in a second plane, the first and second planes being substantially in parallel planes, the first rectangular shape defining a larger area than the second rectangular shape;

a peripheral wall of prismatic form connecting the bottom end and the upper end to define an open base at the bottom end and an open top at the upper end for passage over the metal hook and post of the hanger, the peripheral wall comprising a first and second sidewall that are in parallel planes and that are substantially perpendicular to the first and second plane; and at least one protrusion on an interior of said wall for engaging with the hanger to secure said sizer to the hanger.

2. A sizer as set forth in claim 1 further comprising a pair of said protrusions on opposite sides of said wall for engaging opposite sides of the hanger.

3. A sizer as set forth in claim 1 further comprising a pair of said protrusions on each of two opposite sides of said wall for engaging opposite sides of the hanger.

4. A sizer for a hanger, the hanger having a body, an upstanding post on the body and a metal hook secured in the post, the sizer comprising:

a peripheral wall of prismatic form defining an open base at a bottom end and an open top at an opposite upper end for passage over the metal hook and post of the hanger;

a pair of protrusions, each protrusion disposed on an interior of said wall for engaging with the hanger to secure said sizer to the hanger and disposed in depending relation to project from said peripheral wall to engage in the body of the hanger.

5. A sizer for a hanger having an arched body, an upstanding post on the body and a metal hook secured in the post, said sizer comprising a peripheral wall defining an open base at a bottom end and an open top at an opposite upper end for passage over the metal hook and post of the hanger; and a pair of protrusions on an interior of said wall for engaging with the hanger to secure said sizer to the hanger, each said protrusion being disposed at said upper end of said wall to engage in the post of the hanger.

6. A sizer as set forth in claim 5 further having a pair fins projecting inwardly from said upper end of said wall towards said post to close said open top and a pair of recesses on opposite sides of each said fin to render each said fin flexible relative to said wall, each said fin being disposed in a plane perpendicular to a plane of a respective protrusion.

7. A sizer as set forth in claim 5 wherein each protrusion has a pair of mutually inclined surfaces projecting inwardly of said wall.

8. In combination, a hanger having an arched body, an upstanding post on said body and a metal hook secured in said post, and a sizer, the sizer comprising:

a bottom end proximal to the hanger body and an upper end distal from the hanger body, the bottom end defining a first peripheral rectangular shape in a first plane and the upper end defining a second peripheral rectangular shape in a second plane, the first and second planes being substantially in parallel planes;

a peripheral wall of prismatic form connecting the bottom end and the upper end to define an open base at the bottom end and an open top at the upper end for passage over the metal hook and post of the hanger, the peripheral wall comprising a first and second sidewall that are in parallel planes and that are substantially perpendicular to the first and second plane; and at least one protrusion on an interior of said wall for engaging with said hanger to secure said sizer to said hanger.

9. In combination a hanger having an arched body, an upstanding post on said body, said post having a pair of slots on opposite sides thereof and a metal hook secured in said post, and a sizer comprising a peripheral wall defining an open base at a bottom end and an open top at an upper end for passage over the metal hook and post of the hanger, and a pair of protrusions on opposite sides of an interior of said wall for engaging in said slots to secure said sizer to said hanger.

10. The combination as set forth in claim 9 wherein each said protrusion is disposed at said upper end of said sizer.

11. The combination as set forth in claim 10 wherein said sizer has a pair fins projecting inwardly from said upper end of said wall towards said post to close said open top and a pair of recesses on opposite sides of each said fin to render each said fin flexible relative to said wall, each said fin being disposed in a plane perpendicular to a plane of a respective protrusion.

12. The combination as set forth in claim 10 wherein each protrusion has a pair of mutually inclined surfaces projecting into a respective one of said slots in said post and each said slot has an inclined surface at an upper end facing one of said inclined surfaces of said protrusion.

13. The combination as set forth in claim 10 wherein said hook is secured in said post and has an outside diameter smaller than, an inside diameter of a counterbore of said post to define an annular gap between said hook and said counterbore, and wherein said slots are disposed in the plane of said counterbore.

14. The combination as set forth in claim 10 wherein said hanger has a pair of side walls extending between said body and said post of a width sufficient to prevent rotation of said sizer about said post.

15. The combination as set forth in claim 10 wherein said hanger has a pair of side walls sandwiching said post therebetween and sized to prevent rotation of said sizer about said post.

16. The combination as set forth in claim 9 wherein each said protrusion is a fin projecting inwardly from said upper end of said wall into a respective slot.

17. In combination a hanger having a body, an upstanding post on said body and a metal hook secured in said post, said post having a pair of slots on opposite sides thereof; and a sizer comprising a peripheral wall defining an open base at a bottom end and an open top at an upper end for passage over the metal hook and post of said hanger, and a pair of protrusions on each of two opposite interior sides of said wall for engaging in said respective slots to secure said sizer to said hanger.

18. In combination a hanger having a body, an upstanding post on said body and a metal hook secured in said post, a sizer comprising a peripheral wall defining an open base at a bottom end and an open top at an upper end for passage over said metal hook and post of said hanger, and at least one protrusion on an interior of said wall for engaging with said hanger to secure said sizer to said hanger, and a pair of reinforcing struts on said hanger, each said strut secured to and extending angularly between said body and said post and wherein said protrusion of said sizer is engaged between one of said struts and said post.

19. The combination as set forth in claim 18 wherein said sizer has a pair of said protrusions on each of two opposite sides of said wall, each said protrusion engaging between said post and a respective one of said struts.

20. The combination as set forth in claim 8 wherein said hanger has a pair of seats on opposite sides of said post and wherein said protrusion of said sizer is engaged in one of said seats.

21. In combination a hanger having a body, an upstanding post on said body, a metal hook secured in said post, and a pair of seats on opposite sides of said post, and a sizer comprising a peripheral wall defining an open base at a bottom end and an open top at an upper end for passage over said metal hook and post of said hanger and a pair of protrusions on each of two opposite sides of said wall, each said protrusion having a tang at an end thereof engaging in a respective one of said seats to secure said sizer to said hanger.

22. The sizer of claim 1, wherein the peripheral wall comprises a sloped surface for ease of passing the hook.

23. The sizer of claim 1, wherein the upper end comprises a wall portion perpendicularly disposed to a longitudinal axis of the hanger post.

* * * * *